US005715509A

United States Patent [19]

Staudenmayer et al.

[11] Patent Number: 5,715,509

[45] Date of Patent: Feb. 3, 1998

[54] METHOD AND APPARATUS FOR TRANSFERRING TONER

[75] Inventors: William J. Staudenmayer, Pittsford; William B. Vreeland, Webster, both of N.Y.

[73] Assignee: Eastman Kodak Company, Rochester, N.Y.

[21] Appl. No.: 661,291

[22] Filed: Jun. 10, 1996

[51] Int. Cl.[6] ..... G03G 15/16

[52] U.S. Cl. ..... 399/308; 399/297; 399/318

[58] Field of Search ..... 399/296, 308, 399/297, 318, 328, 330, 331, 333, 339, 390; 430/126, 124; 156/277; 428/914

[56] References Cited

U.S. PATENT DOCUMENTS

| | | | |
|---|---|---|---|
| 4,419,004 | 12/1983 | Kuehnle . | |
| 4,419,005 | 12/1983 | Kuehnle . | |
| 4,540,251 | 9/1985 | Yau et al. | 350/611 |
| 4,927,727 | 5/1990 | Rimai et al. | 430/99 |
| 4,968,578 | 11/1990 | Light et al. | 430/126 |
| 5,043,768 | 8/1991 | Baruch . | |
| 5,061,590 | 10/1991 | Johnson et al. | 430/126 |
| 5,084,735 | 1/1992 | Rimai et al. . | |
| 5,153,656 | 10/1992 | Johnson et al. . | |
| 5,187,526 | 2/1993 | Zaretsky . | |
| 5,196,894 | 3/1993 | Merle et al. . | |
| 5,325,158 | 6/1994 | Guelfo et al. . | |
| 5,342,726 | 8/1994 | Lima-Marques | 430/126 |
| 5,351,114 | 9/1994 | Matsuno . | |
| 5,414,488 | 5/1995 | Fujita et al. . | |
| 5,424,163 | 6/1995 | Tokunaga et al. | 430/124 |
| 5,428,430 | 6/1995 | Aslam et al. . | |
| 5,428,432 | 6/1995 | Mitani . | |

OTHER PUBLICATIONS

Stanley W. Angrist, Direct Energy Conversion, 1977, 166–167.

*Primary Examiner*—Matthew S. Smith
*Attorney, Agent, or Firm*—Leonard W. Treash, Jr.

[57] ABSTRACT

To assist transfer of toner images from a first transfer surface to a second transfer surface, the first transfer surface is actively cooled to prevent the toner sticking to it. Preferably, the cooling is accomplished by thermoelectric control device strips positioned in heat conducting relation with the first transfer surface. A thermoelectric control device can also be used to heat a second or receiving surface to which the toner is to be transferred to farther assist the transfer process.

12 Claims, 3 Drawing Sheets

METHOD AND APPARATUS FOR TRANSFERRING TONER

This invention relates to the transfer of toner to a receiving surface. Although not limited thereto, it is particularly usable in the transfer of toner images from a surface of an image member on which the image is formed to a surface of an intermediate image member and to the transfer of the toner image from the intermediate image member surface to another surface, for example, a surface of a sheet or web or of another intermediate member. The invention is also usable in direct transfer from the original image member to a receiving sheet or web, and in transferring toner not in image configuration.

The resolution of a toner image is limited by the size of the toner particles in the toner image. A problem to overcome in using fine toner in imaging is that the smaller the toner particle the more difficult it is to transfer it from one surface to another, especially to transfer it electrostatically.

U.S. Pat. No. 4,968,578, issued Nov. 6, 1990 to Light et al, and U.S. Pat. No. 4,927,727, issued May 27, 1990 to Rimai et al, describe a method of transferring toner particles by heating a receiver to a temperature which sinters the toner particles, causing them to stick to each other and to the receiver, thereby effecting transfer of the toner from a donor (for example, a photoconductive image member) to the receiver.

U.S. Pat. No. 5,061,590 to Johnson et al, issued Oct. 29, 1991, suggests that an internally heated hard metallic roller to which a receiving sheet is attached will help effect precise temperature control in a transfer nip. Other references suggest that further heat control can be effected by also heating the original image member, generally a photoconductive member; see, for example, U.S. Pat. No. 5,153,656 to Johnson et al, issued Oct. 6, 1992, and U.S. Pat. No. 5,196,894 to Merle et al, issued Mar. 23, 1993.

U.S. Pat. No. 5,428,430 to Aslam et al is one of several references suggesting heat assisted transfer of a toner image from a photoconductive image member to a conductive intermediate with the assistance of an electric field and the subsequent heat assisted transfer of the toner image from the conductive member to a receiving sheet.

While heat assisted transfer under controlled conditions can provide high transfer efficiency of extremely small particles, it has been a challenge to develop it into a robust technology because of problems associated with temperature control and blistering of some receivers. At the same time, intermediate electrostatic transfer has been substantially improved. For example, U.S. Pat. No. 5,084,735 to Rimai et al, issued Jan. 28, 1992, describes a compliant intermediate with a hard overcoat that provides substantially improved electrostatic transfer with toner of all sizes. It is particularly useful in color systems with toner having transfer assisting addenda. See also, U.S. Pat. No. 5,187,526 to Zaretsky, issued Feb. 16, 1993. In transferring highest quality images electrostatically, one of the challenges faced in these references is to provide surfaces, both on the photoconductive image member and the intermediate which facilitate rather than retard movement of the toner from the photoconductor to the intermediate. The same surface characteristics must, in turn, not inhibit movement of the toner from the intermediate to a receiving sheet.

SUMMARY OF THE INVENTION

It is an object of the invention to improve transfer of toner, especially, but not limited to, toner images made up of small toner particles.

According to one aspect of the invention, these and other objects are accomplished by providing a temperature gradient in a transfer nip which will encourage the movement of toner from a donor surface to an acceptor or receiver surface.

According to a preferred embodiment, the donor surface is actively cooled, preferably by the use of a thermoelectric control device (TECD) associated with the donor surface.

According to another preferred embodiment, an intermediate transfer member includes a TECD around its periphery which can be electrically controlled to heat the surface of the intermediate transfer member when it is the receiver surface and then to cool the same surface when it is the donor surface.

In one preferred embodiment, the TECD is used in heat assisted transfer, such as that described in references such as U.S. Pat. No. 4,927,727, Rimai et al, and others mentioned above. In another preferred embodiment, the TECD is particularly usable to enhance the transfer efficiency of conventional electrostatic transfer.

A conventional electrophotographic image forming apparatus can have a temperature in the transfer area raised by other components to as much as 20° to 50° F. above ambient. If this causes any tackiness in the toner (or photoconductor), transfer becomes more difficult. Accordingly, in its simplest form, the invention can be used to cool a photoconductive image member substantially below what would be the normal, raised operating temperature in a transfer area to prevent the toner from sticking to the photoconductive image member and facilitating more complete transfer electrostatically to the receiver surface. At the same time, if the receiver is heated somewhat above ambient, even electrostatic transfer can be further enhanced.

In a more extensive use of the invention, heat is the main vehicle for transfer and is augmented by cooling the donor surface.

The use of thermoelectric control devices in any transfer process allows very close control of the cooling (or heating) electrically and, according to preferred embodiments mentioned above, allows both heating and cooling with the same elements.

DETAILED DESCRIPTION OF THE INVENTION

A TECD (thermoelectric control device) controls temperature according to the electric polarity across its process elements. The process elements can either be dissimilar metals, incorporating a Peltier effect, or a thermoelectric couple consisting of N and P type semiconductor materials. A TECD can contain as few as one couple to as many as the available power source can handle. Regulation of polarity and current allows for heating or cooling. Such devices have been well known for years. See, for example, *Direct Energy Conversion* by Stanley W. Angrist, Third Edition, pp. 166–167, published 1978 by Allyn and Bacon, Inc. of Boston. The devices are also sometimes called "thermoelectric heat pumps;" see, for example, U.S. Pat. No. 4,540,251 to Yau et al, issued Sep. 10, 1985.

The devices have two advantages that make them particularly useful in the transfer of toner images. First, they are capable of precise heating and cooling in very localized and controlled positions. Secondly, the same devices can be switched between a heating mode and a cooling mode by a change of electrical polarity. Use of these advantages in transfer will be better explained by reference to the embodiments shown in the FIGS.

Figure 1:
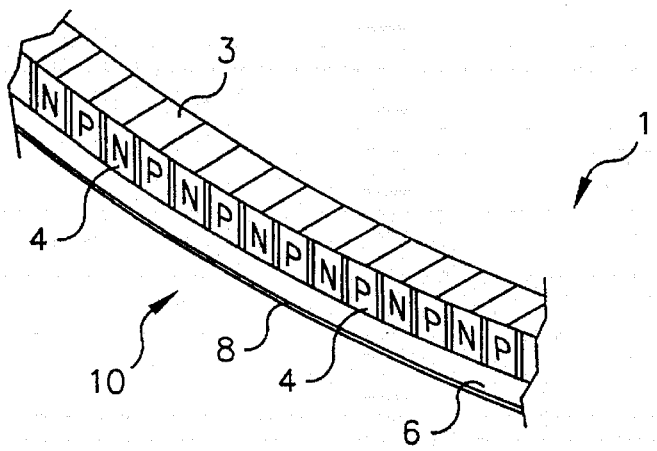
FIGS. 1 and 6 are magnified schematic sections of a portion of an image member, not drawn to scale.

According to FIG. 1, an image member 1, which can be a roller, belt or other comparable device, includes a core 3 upon which are mounted thermoelectric control device strips 4. The TECD strips are covered by a layer of suitable material, which is preferably electrically insulating but heat conducting, such as, a thin metallic oxide ceramic 6. Layer 6 is preferably covered by a thin sleeve 8 of material which defines the surface 10 on which a toner image is to be supported and from which or to which it is to be transferred. If image member 1 is a photoconductive image member, then layer 8 is usually a photoconductive material, although it can be a dielectric overcoating for a photoconductive material. If image member 1 is an intermediate transfer member, then layer 8 is generally a hard polyurethane, silicone rubber or other similar material having good release characteristics.

Figure 6:
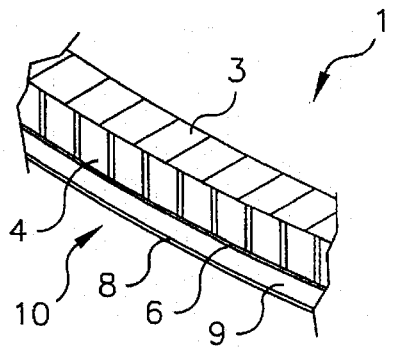

In a typical transfer nip, it is desirable to have some compliance in one of the transfer members. Thus, FIG. 6 shows an embodiment of the image member 1 in which a compliant layer 9 is positioned between layers 6 and 8. Layer 9 can be of a more compliant material, such as polyurethane, silicone rubber or the like, than is layer 8. Layer 9 has a thickness and hardness to provide the required compliance to image member 1 for the application in question, while layer 8 provides release and/or photoconductive features.

Figure 2:
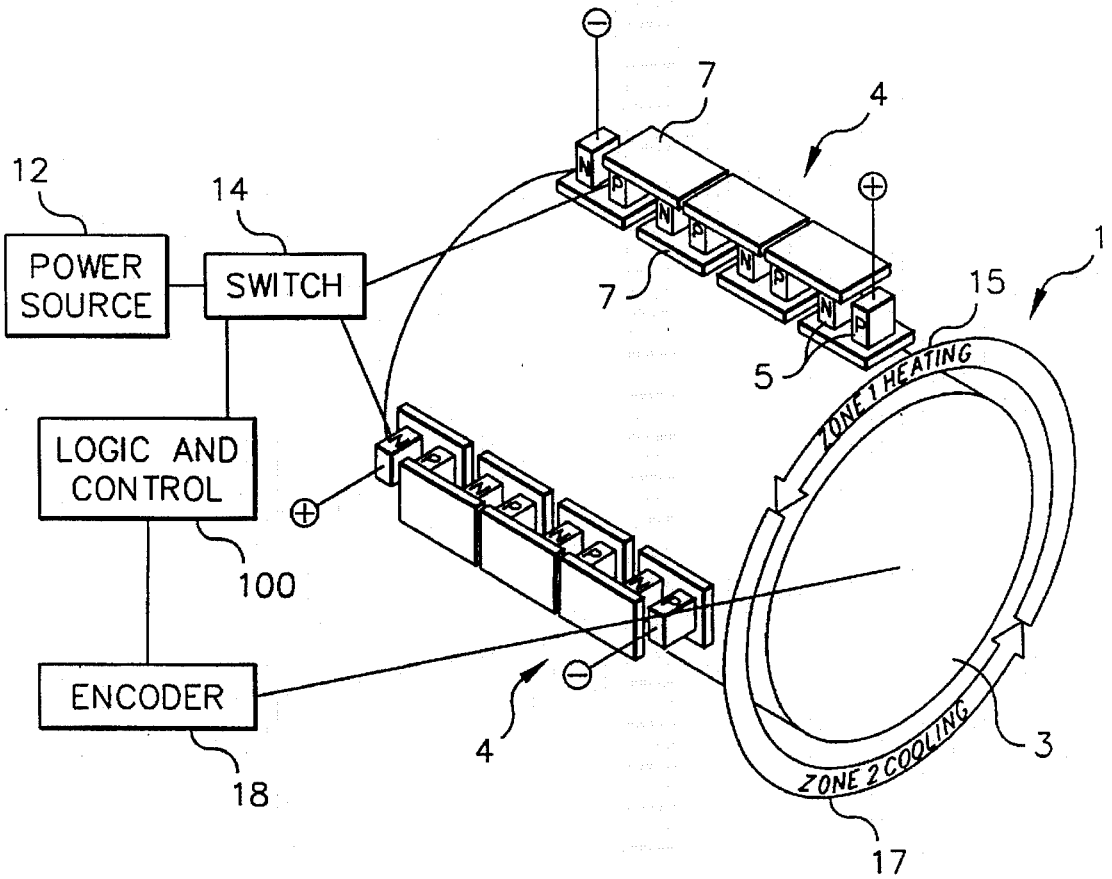
FIG. 2 is a perspective schematic of the inside of a drum-shaped image member with portions eliminated for clarity of illustration.

The TECD strips 4 are best seen in FIG. 2, exaggerated in size, with respect to core 3. (The other layers have been eliminated in this FIG. for clarity.) The TECD strips are made up of N and P elements 5 which are connected in series, as shown, by copper bus bars 7.

Thermoelectric control devices presently manufactured are suitable for this application. For example, a thermoelectric control device is available from Melcor Corporation, identified as Model SCO.45-4-05 which has outer dimensions on its cold side of 1.8 mm×3.4 mm (0.07"×0.14") with maximum heat transfer capacity of 23 W/in.$^2$ for no temperature difference generated between its hot and cold faces. This model comprises four side-by-side pairs of 0.45 mm×0.45 mm elements, each 1.5 mm high. This model would be suitable for lower temperature embodiments. A custom-made analogue of a newly announced model from Melcor Corporation, Model HT6-12-40, but cut to narrower cross-sectioned dimensions of 0.45 mm×0.45 mm and with-maximum heat transfer capacity of 23 w/sq. in. for no temperature difference generated between its hot and cold faces, is more suitable for higher temperature embodiments. Preferably, a strip of individual elements of this size and type is positioned only one element wide, spanning the full width of the image member or transfer member.

A preferred image member 1, constructed as a roller, has an outer diameter of 7.5 in. and accommodates 270 TECD strips around its perimeter. As can be seen from the FIGS., N and P elements alternate in both cross-track and in-track directions. The elements in each TECD strip are electrically in series. Each strip is connected to a power source 12 independently of the other strips. This allows a switch 14, controlled by logic and control 100 working off an encoder 18, to control the polarity of the strips according to their angular position as transfer member 1 rotates.

Figure 3:
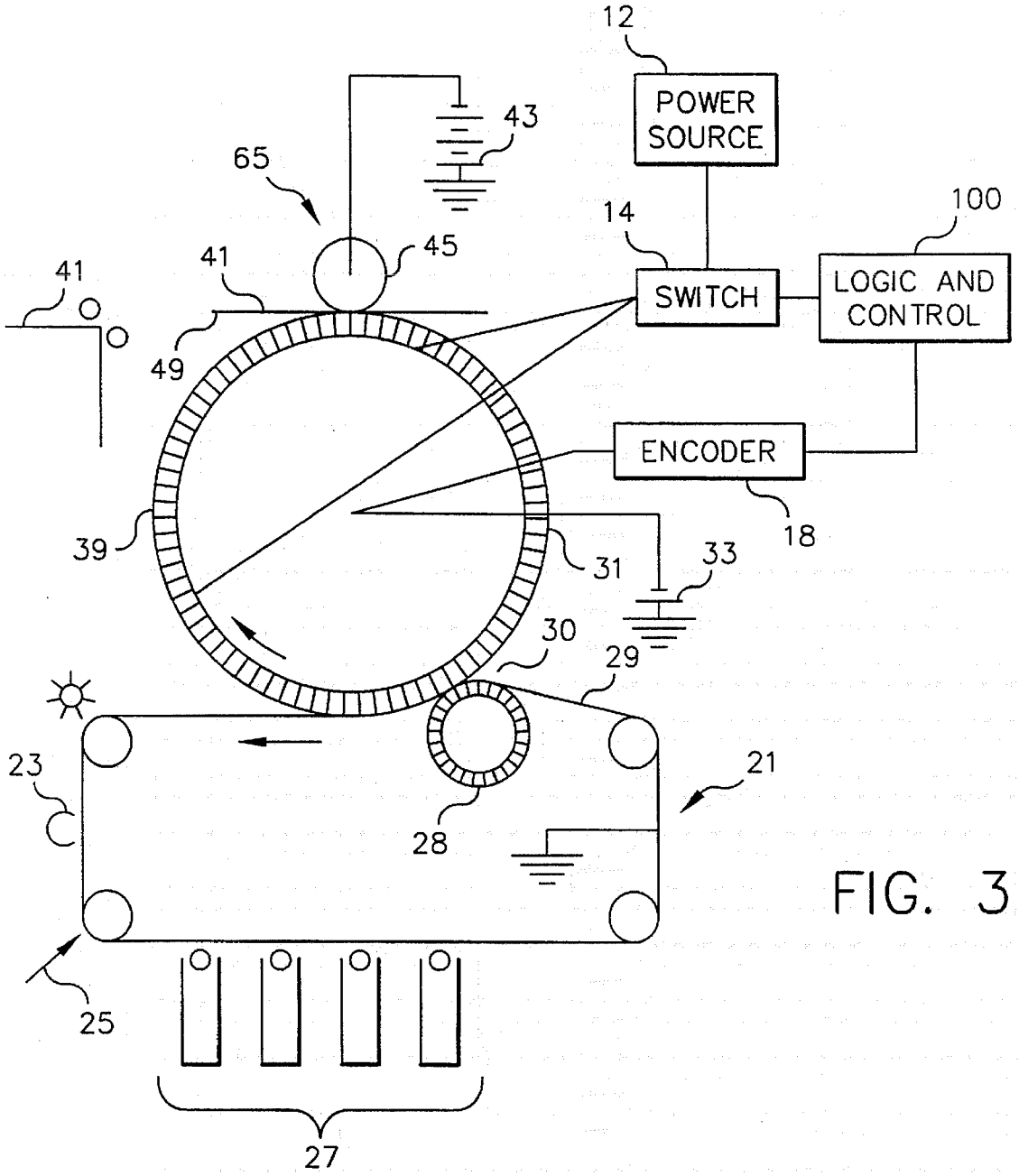
FIGS. 3, 4 and 5 are side schematic sections of portions of an image forming apparatus.

Operation and usefulness of the invention will be best understood with respect to an embodiment shown in FIG. 3. According to FIG. 3, an image forming apparatus includes a photoconductive image member 21 which will also sometimes be referred to as a "transfer member." Image member 21 is in the form of a web trained around a series of rollers. Toner images are formed electrophotographically on a transfer surface 29 of image member 21 using a conventional charging station 23 and an exposing station, for example, a laser exposing station 25, to form an electrostatic image which is toned by one of toning stations 27 to form a toner image. Toning stations 27 each contain different color toners in order to provide different color toner images. The toner image is transferred from transfer (donor) surface 29 of image member 21 to a transfer (receiver or acceptor) surface 39 of an intermediate transfer member 31. Transfer is accomplished in a nip 30 formed by image member 21 and transfer member 31. The nip is elongated in the in-track direction by the action of a backup roller 28 positioned to force some wrap of image member 21 around surface 39 of image member 31. Transfer is accomplished, in part, in nip 30 by an electrostatic field created between transfer member 31 by a voltage source 33 and a grounded backing electrode on image member 21.

A single toner image can be transferred to surface 39 from where it, in turn, can be transferred at a transfer station 65 to a surface 49 of a receiving sheet or web 41 under the action of an electrostatic field created by a power source 43 on a backing roller 45 to receiving sheet 41 and the intermediate transfer member 31.

According to a preferred embodiment, color images are formed by formation of a series of different color toner images on image member 21 and transferring them in registration to intermediate transfer member 31 to form a multicolor image on surface 39. The multicolor image is then transferred in a single step to surface 49 of receiving sheet 41. Preferably, backing roller 45 is articulated away from intermediate transfer member 31 until the full color image has been formed, and receiving sheet 41 is being positioned to receive it.

This much is generally shown in the prior art; see, for example, U.S. Pat. No. 5,084,735 to Rimai et al, referred to above. To improve on this prior method and apparatus, FIG. 3 shows the use of TECD snips in both backup roller 28 and intermediate transfer member 31. According to the invention, the TECD snips in backup roller 28 are set, in operation, to continually cool image member 21 as it enters the transfer nip 30. This cooling reduces the risk that the apparatus in general will heat the toner until it has a tendency to stick to surface 29. Thus, surface 29, which is a "donor surface," is maintained in a cool condition for the first transfer of the toner image to surface 39.

To further assist in the transfer, surface 39 can be warmed somewhat by a TECD in intermediate transfer member 31. This will provide a temperature gradient in the nip 30 which will provide both a pull for the toner to surface 39, the receiving, receiver or acceptor surface, and a reduction in resistance to that pull with respect to the donor surface, surface 29.

Because the TECDs are reversible, this process can be essentially repeated at the second transfer to receiving surface 49 on receiving sheet 41. Accordingly, logic and control 100, again operating off encoder 18, switches the polarity on the TECD strips according to the angular position of intermediate transfer member 31, to change the TECD strips from heating to cooling as they approach the second transfer associated with receiving sheet 41 and backing roller 45. This cools the surface 39 (now the donor surface) and the toner image and reduces the resistance to the toner image leaving surface 39, thereby increasing the efficiency of transfer to surface 49. Backing roller 45, in turn, can be heated by TECDs or other means to further assist in the second transfer process.

Note, that this process shown in FIG. 3 has two aspects to it. First, it can be used as shown to facilitate ordinary electrostatic transfer of the type shown in U.S. Pat. No. 5,084,735, referred to above. Alternatively, it can be used with or without an electrostatic assist for heat assisted transfer as suggested in U.S. Pat. Nos. 4,927,727 and 4,968,578 to Light et al, referred to above. In the latter process, the receiving surface is heated enough to soften or tackify toner particles that contact it. This can be assisted by an electrical field of a direction urging the transfer.

The usefulness of the invention as an assist to electrostatic transfer is illustrated by a test in which conventional electrostatic transfer from a photo conductive image member to a transfer roller containing an elastomer coating in the presence of a conventional electrical field was tried through a range of temperatures from 116° F. down to 46° F. The results are shown in the following table. Note the substantial improvement in electrostatic transfer in merely reducing temperature from a normal elevated temperature in a transfer station (116° F.) to ambient (72° F.). Even greater benefits are obtained with further reduction. Although it is within the scope of the invention to use other cooling means to cool a donor surface, the control and compactness of a TECD make it an advantageous choice.

| Image Member Temperature °F. | % of Untransferred Toner on Image Member |
|---|---|
| 116 | 4.6 |
| 95 | 3.5 |
| 72 | 2.0 |
| 55 | 1.3 |
| 46 | 1.1 |

Figure 4:
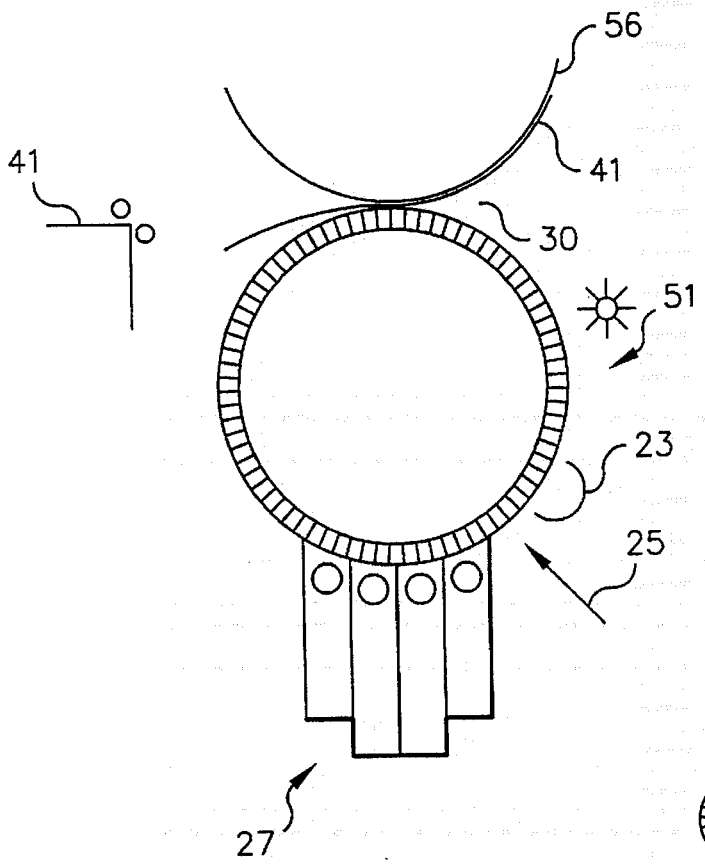

FIG. 4 illustrates direct transfer of toner images created on a photoconductive image member 51 in the form of a roller or drum to a receiving sheet 41 which is secured to a transfer roller 56 for multiple presentations to nip 30 to receive a plurality of different color toner images in registration. In FIG. 4, image member 51 includes TECD strips, preferably as shown in FIG. 1, which allow it to be cooled in the nip 30. Whether it is more energy efficient to turn the cooling mechanism on just in nip 30 or throughout the path of the periphery of image member 51, depends on the conditions and materials used. However, using a TECD, it is an option to just cool in the nip 30 by merely turning the TECD strips on for that portion of their travel. Backing roller 56 could be heated in this embodiment using TECDs or otherwise to further enhance transfer efficiency.

Figure 5:
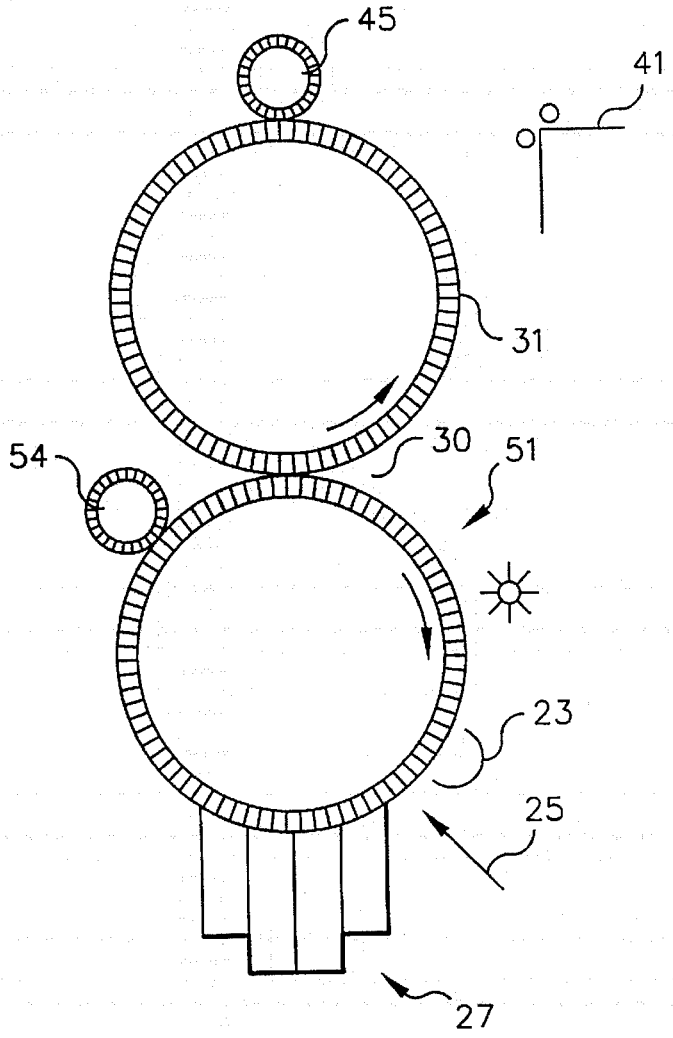

Referring to FIG. 5, a somewhat different arrangement is shown. Image member 51 is preferably constructed, as shown in FIG. 6, with a compliant layer 9 between the TECD strips and the photoconductive layer or layers 8. Toner images are formed, as in FIG. 4, on the surface of image member 51 and transferred in nip 30 to an intermediate transfer member 31, as shown in FIG. 3. Since some compliance is desirable, especially in nip 30, that is provided by photoconductive image member 51 in FIG. 5, and intermediate transfer member 31 can be relatively noncompliant. This allows the TECD elements to be positioned closer to the surface of transfer member 31. In this embodiment, backing roller 45 also contains TECD strips which are used to heat the toner when transferring to the receiving sheet 41, which toner is, at the same time, being cooled by the TECD strips opposite transfer roller 45.

The FIG. 5 embodiment operates essentially as that in FIG. 3, except that both of the transfer members 51 and 31 are drums and only transfer member 51 (the photoconductive image member) contains substantial compliance.

Also shown in FIG. 5 is a cooling roller 54 which is positioned upstream of nip 30 and in close proximity to the donor surface of transfer member 51. Cooling member 54 is biased to prevent the pickup of toner and has a periphery covered with TECD strips which are run in a permanent cooling mode to cool the surface and toner associated with the surface of image member 51 as it enters nip 30. This feature can be used to augment the cooling effect of the TECDs shown in FIG. 5 or it can be used in place of them.

The TECDs used in the FIGS. are especially remarkable when they are used to cool in one instance and heat in others. However, even when they are used without this flexibility, for example, to just cool or just heat, they are particularly advantageous in their compactness and in their electrically controlled responsiveness to hold temperature within narrow limits. When used in the transfer to a high quality coated or surface finished receiving sheet, it helps reduce blistering caused by poor temperature control.

Although the invention is shown in the transfer of toner images, it is also known to transfer toner to a surface, which toner is not in image configuration. The toner then can be fused to protect or enhance the gloss of the surface to which it has been transferred. Thus, the invention is not limited to transfer of toner in image configuration.

The invention has been described in detail with particular reference to a preferred embodiment thereof, but it will be understood that variations and modifications can be effected within the spirit and scope of the invention as described hereinabove and as defined in the appended claims.

We claim:

1. An image forming apparatus comprising:

a first transfer member having a donor surface for supporting a toner image, a second transfer member having a receiving surface for receiving a toner image, said first and second transfer members being positioned with the donor and receiving surfaces in transfer relation, and a thermoelectric control device (TECD), located adjacent the area where the donor and receiving surfaces are in transfer relation, for cooling the donor surface at least where it is in such transfer relation, and means for effecting transfer of a toner image from the donor surface to the receiving surface.

2. Image forming apparatus according to claim 1 wherein the first transfer member is a photoconductive image member and the image forming apparatus includes means for forming a toner image on the donor surface.

3. Image forming apparatus according to claim 2 wherein the second transfer member is an intermediate transfer member and the image forming apparatus further includes means for transferring the toner image from the receiving surface to another surface.

4. Image forming apparatus according to claim 3 further including a TECD associated with said intermediate transfer member, said TECD heating said intermediate transfer member in the area where the donor and intermediate members are in transfer relation and cooling said intermediate transfer member for in the area where the toner image is transferred from the receiving surface to another surface.

5. Image forming apparatus comprising:

a photoconductive image member defining a first toner image bearing surface, means for forming a toner image on the first surface, means for transferring the toner image from the first surface to a second surface in a transfer zone, and a thermoelectric control device (TECD) including a series of TECD strips arranged across an in-track direction of and positioned adjacent the first toner image bearing surface for cooling the photoconductive image member in the transfer zone.

6. Image forming apparatus according to claim 5 wherein the means for transferring includes a TECD for heating the second surface sufficiently to transfer the toner image to the second surface.

7. Image forming apparatus according to claim 5 wherein the means for transferring includes means for applying an electrical field to the toner image of a direction urging transfer of the toner image to the second surface.

8. Image forming apparatus according to claim 5 wherein the means for transferring includes TECD for heating the second surface sufficiently to soften toner contacting it and means for applying an electrical field of a direction urging transfer of toner to the second surface.

9. Image forming apparatus according to claim 8 further including a TECD associated with said second surface, said TECD heating said second surface in the area where the first and second surfaces are in transfer relation and cooling said second surface for in the area where the toner image is transferred from the second surface to another surface.

10. Image forming apparatus comprising:

a first transfer member having a first surface for supporting toner, which surface is movable through an operative path in an in-track direction, a second transfer member having a second surface for supporting toner and engageable with the first transfer member to form a transfer nip and movable in an in-track direction, with both the first and second surfaces moving in their in-track directions in the nip, said second transfer member including a plurality of thermoelectric control device strips across its in-track direction and in heat conducting relation with the second surface, means defining a transfer station through which a receiving sheet is movable into transfer relation with the second surface of the second transfer member, and means for adjusting the thermoelectric control device strips to heat the second surface as it passes through the nip with the first surface and to cool the second surface as it passes through the transfer station.

11. Image forming apparatus according to claim 10 wherein the first transfer member is a photoconductive image member and said apparatus includes electrophotographic means for forming a toner image on the first surface.

12. Image forming apparatus according to claim 11 including means for creating an electrostatic field in the transfer nip of a direction urging transfer of the toner image from the first surface to the second surface.

* * * * *